United States Patent [19]

Fay et al.

[11] Patent Number: 4,951,879

[45] Date of Patent: Aug. 28, 1990

[54] LIQUID DISTRIBUTION DEVICE

[76] Inventors: James N. Fay, 2316 NE. Parkview Dr., Vancouver, Wash. 98686; Mark A. Cooper, 22512 NE. 58th St., Vancouver, Wash. 98662

[21] Appl. No.: 275,207

[22] Filed: Nov. 23, 1988

[51] Int. Cl.[5] ..... B05B 1/20; D06B 1/02

[52] U.S. Cl. ..... 239/553.5; 239/566; 162/60; 210/409

[58] Field of Search ..... 239/553, 553.3, 553.5, 239/556, 566, 568, 523, 554, 601; 210/391, 393, 402, 409; 162/60

[56] References Cited

U.S. PATENT DOCUMENTS

| | | | |
|---|---|---|---|
| 329,527 | 11/1885 | Beall | 239/597 |
| 2,673,763 | 3/1954 | Dunn | 239/553.3 |
| 2,940,418 | 6/1960 | Penrod et al. | 118/63 |
| 3,032,100 | 5/1962 | Schibbye | 162/308 |
| 3,134,654 | 5/1964 | Russell | 34/160 |
| 4,435,891 | 3/1984 | Nicholson | 29/157 |
| 4,511,088 | 4/1985 | Wilt et al. | 239/455 |
| 4,522,716 | 6/1985 | LaValley | 210/210 |
| 4,535,936 | 8/1985 | Fontaine | 239/117 |
| 4,697,292 | 10/1987 | LaValley | 239/523 |

*Primary Examiner*—Andres Kashnikow
*Assistant Examiner*—Karen B. Merritt
*Attorney, Agent, or Firm*—Hughes & Multer

[57] ABSTRACT

This invention is an improved liquid distribution device and more particulary an elongated shower pipe which uses a reinforced, enclosed, curved vane and a plurality of uniquely designed spray outlets to evenly dispense a controlled, continuous thin sheet of liquid spray, having a substantially equal rate of application, velocity, pressure, consistency, and thickness, across a width of a rotary drum, the spray having a uniform, somewhat staggered and overlapping spray pattern. The enclosed curved vane significantly resists breakage when impacted against a pulp buildup and prevents debris from disrupting the spray pattern.

31 Claims, 5 Drawing Sheets

LIQUID DISTRIBUTION DEVICE

TECHNICAL FIELD

This invention relates generally to fluid distribution devices and more particularly to shower pipes used to distribute a liquid onto a rotary drum.

BACKGROUND ART

Many industrial operations require that a supply of liquid be evenly distributed into a continuous thin sheet which is deposited onto a surface. One such operation is found in the pulp and paper making industry, wherein a spray of liquid is used to wash chemicals through a pulp sheet. A vacuum is applied within a cylinder or drum upon which the pulp sheet is positioned to pull liquids or filtrate applied to the sheet through the sheet, thus washing or removing such chemicals.

In such an operation, a large rotary drum supported at its ends is commonly used. The drum is covered by a filter screen and the interior of the drum is exposed to a vacuum plenum. The drum is partially submerged into a pool of wood pulp, the wood pulp being dispersed in a pulp slurry or filtrate. As the drum rotates through the pool, wood pulp and pulp slurry are collected against the outer surfaces of the filter screen to form a wet mat of pulp fibers. As the filter screen emerges from the pool, the pulp slurry is drawn inwardly against the filter screen, and the chemical laden filtrate is drawn through the filter screen and is subsequently discharged through suitable piping.

The wet mat is preferably washed through one or more washing stages. Each stage is in continuous rotation. Washing is only performed during the wash cycle on each stage. There may be one or more showers used in the wash cycle. The fibers washed will only see the filtrate or wash water from each shower once during rotation on each drum. The chemicals which are used in the pulp slurry are recovered. The recovered chemicals may then be reprocessed and reused. Washing of the mat is achieved by directing a spray of water wash toward the wet pulp mat to displace the chemical-laden pulp slurry from the mat. The water wash should be applied gently to prevent damage to the mat. A thin spray or film of water is usually used. The water wash is commonly applied through multiple parallel shower pipes which are angularly spaced around a segment of the rotary drum. The shower pipes extend axially along the length of the drum and are supported at their ends. Usually, the shower pipers are placed from just above the surface of the pool inlet side to the top of the drum, proceeding in the direction of drum rotation. The shower pipes have similar lengths and are spaced a fixed distance from the filter screen so that spray intensity and distribution are substantially uniform across the width of the mat. Drum sizes may be different lengths, but showers on a given drum are the same length.

The following patents relate to devices used in the paper and pulp industry. A variety of different shower pipes have been developed in an attempt to evenly distribute such a water wash. Some shower pipes are designed with an exterior flange or spillway surface to direct a spray or film of water tangentially toward the moving pulp mat. LaValley (U.S. Pat. No. 4,522,716, issued June 11, 1985); Wilt et al. (U.S. Pat. No. 4,511,088, issued Apr. 16, 1985); and Schibbye (U.S. Pat. No. 3,032,100, issued May 1, 1962) disclose liquid distribution devices having curved exterior spillways.

Schibbye ('100) also discloses the use of vertical guide vanes which are positioned parallel to the flow of water. Penrod et al. (U.S. Pat. No. 2,940,418, issued June 14, 1960) discloses an air doctor device used to discharge pressurized air through a slot for smoothing a fluid slurry coating material that has been applied to the surface of a paper web. Russell (U.S. Pat. No. 3,134,654, issued May 26, 1964) discloses a high velocity dryer tube arranged to discharge gases, such as steam or air.

Other liquid or gas discharge devices may be found in non-analogous art. For example, Fontaine (U.S. Pat. No. 4,535,936, issued Aug. 20, 1985) discloses an air blast nozzle, wherein air is blasted out through an elongated slot, for blowing liquids off of surfaces such as sheet metal. Nicholson (U.S. Pat. No. 4,435,891, issued Mar. 13, 1984) discloses a method of manufacturing a sanitary fan spray nozzle for use in the food industry and particularly for use within a cheese filter. Beall (U.S. Pat. No. 329,527, issued Nov. 3, 1885) discloses a burner for a gas-stove.

The shower pipe devices known in the prior art have only been partially successful in meeting the needs of the paper and pulp industry. The previously known devices tend to cause damage to the pulp mat and accompanying machinery and often do not provide an effective spray pattern.

For example, during the removal process of the washed pulp mat, some wood pulp often is ineffectively washed. Poor consistency upon startup because of fluctuations in the vacuum causes thick and thin spots in the pulp mat. The thick areas wedge under the shower pipes between the drum and the shower. This wedging effect in concert with the rotation of the drum produces the damaging effect further described below. More particularly, the pulp build-up can break the exterior flanges, spillways, or nozzles of the shower pipes. The previously known shower pipe devices are not designed to provide adequate resistance to fatigue or failure, as described above. Substantial damage and loss of operational time occurs when the shower pipes are incapacitated due to breakage or clogging. Such damage is particularly prevalent where the shower pipes are in close proximity to the outer surface of the pulp mat.

Another persistent problem is the tendency of the shower pipes to sag. Rotary drums often exceed twenty feet in length. This requires the shower pipes to be even longer if complete spray coverage is to be obtained. The shower pipes are usually supported at their ends, and sometimes have an intermediate support. During the washing procedure, the shower pipes are filled with water or another washing liquid. The combined weight of the shower pipe and the contained liquid often causes the pipes to sag. Sagging or deformation can also be caused by manloading during inspection or plant outage periods. Sagging causes the shower pipe to apply the liquid at different velocities and consistencies along the length of the drum. The result is a very ineffective spray pattern. Uniformity and thickness of the spray consequently suffers. Another result of a sagging shower pipe is the increased likelihood that damage will occur to either the mat or operating machinery. Damage is usually caused by the inadvertent contact between the mat, filter or drum, and the shower pipes.

The spray patterns of the previously known shower pipes have also been found to be inconsistent in uniformity and thickness across the width and length of the pulp mat. It is desirable to wash the pulp mat uniformly across its width using a continuous or overlapping spray which traverses the axial length of the drum. To achieve a proper spray, a single or double row of spray holes spaced along the length of the shower pipe have been used. An exterior continuous lip, flange, or spillway may also be positioned diagonally across the spray outlets or holes to cause the fluid being sprayed from the outlet to fan outwardly. The previously known designs have had only limited success in providing a uniform spray because eddies in the liquid flow cause a buildup of wash liquid to occur near the outlet opening or orifice and along the flange or spillway. The previously known spillways also tend to accumulate debris from the spray-back or accumulation of random pulp mat as a result of the washing process. Such debris tends to plug the spray outlets of the shower pipes and disrupts uniformity of spray patterns, thereby negatively affecting the spray configuration.

Citation of the above listed references do not constitute an admission that the references are relevant or material to the present claims. These references are cited only as constituting the closest art to the general field of disclosure of which the applicant and his attorneys are aware. None of the references incorporate the combination of features taught in the present invention, nor do the previously known devices impart the same degree of effectiveness or efficiency as found in the present invention.

DISCLOSURE OF INVENTION

Accordingly, it is the general object of the present invention to provide an improved liquid distribution device, such as a shower pipe for use with a rotary drum, which evenly distributes a controlled, continuous sheet of liquid spray across a width of a receiving surface, the liquid being dispensed at a substantially uniform rate, velocity, consistency and thickness, this being accomplished with the liquid spray having a uniform, generally staggered and overlapping spray pattern.

Another object is to provide a device having sufficient strength and rigidity to substantially resist sagging when the device is spanned over great lengths and is exposed to elevated temperatures, the device also having sufficient strength to withstand an impact against an accumulation of pulp buildup and to resist abrasion against such pulp buildup.

Another object is to provide a device having a plurality of spray outlets which are substantially less susceptible to clogging caused by having an excess amount of liquid or debris accumulate about the spray outlets.

Another object is to provide such a device which has adequate structural strength and integrity to alleviate some of the problems discussed above.

Another object is to provide an improved method of evenly applying the liquid spray onto a receiving surface.

This present invention is an improved liquid distribution device which uses a reinforced curved vane and a plurality of uniquely designed orifices or outlets to evenly distribute a controlled, continuous thin sheet of liquid spray across a width of a receiving surface. More particularly, this invention is an improved shower pipe having an elongated conduit wherein a plurality of reservoir outlets dispense fluid from a reservoir in a fan shape onto an enclosed, curved vane or lower portion of a rear wall which directs the fluid toward a plurality of spray outlets formed in the conduit. The reservoir outlets, the reinforced, curved vane or lower portion, and the spray outlets cause the liquid sprays to be dispensed from the shower pipe with a substantially uniform rate of application, velocity, pressure, consistency and thickness along the length of the shower pipe. The liquid sprays have a uniform, somewhat staggered and overlapping spray pattern.

The resulting liquid sprays may be directed across the width of a pulp mat being carried on a rotating drum. The liquid being sprayed may be a water wash, a bleach wash, or any other desired liquid having a similar viscosity. Application of such liquids is frequently required within the pulp and paper making industry to effectively wash or bleach the pulp mat during the preparation of paper products. By causing the spray to be substantially uniform, better quality paper is produced, less manufacturing difficulties are encountered, and a greater amount of chemicals used in the process can be recovered from the pulp mat. The recovered chemicals may be processed and reused, thereby economizing on the chemicals being consumed and reducing manufacturing costs.

The present invention includes an improved design which provides the device with sufficient strength and rigidity to substantially resist sagging, to withstand an impact against an accumulation of pulp buildup, and to resist abrasion against such pulp buildup. The device is also substantially less susceptible to becoming clogged by excess liquid or debris accumulating around the spray outlets of the device.

The present invention also incorporates an improved method of evenly applying a liquid spray to a receiving surface.

The present invention comprises a reservoir means to receive and contain a supply of fluid. The reservoir means may be partitioned into one or more reservoirs with a baffle means or compression leg. The baffle means causes the fluid and hydraulic pressures associated therewith to be evenly distributed along the length of the reservoir means. The baffle means also gives the invention added structural strength and rigidity to resist bending. The baffle means can be easily removed to allow easy access to the interior of the reservoir means. The reservoir means is provided with a plurality of reservoir outlets through which the fluid is dispensed into a discharge means. In the preferred embodiment, the reservoir outlets have a "D"-shaped configuration which causes the dispensed fluid to fan outwardly into the discharge means without experiencing adverse overspray.

The discharge means comprises a reinforced, enclosed, curved vane and a discharge wall. An upper edge of the curved vane is positioned near the reservoir outlets to receive the fluid dispensed from the reservoir means and redirect the fluid through approximately a ninety (90) degree curve. The lower edge of the curved vane is integrally connected to the lower edge of the discharge wall. The upper edge of the discharge wall may be attached to the reservoir means. A plurality of spray outlets are formed or cut into the juncture between the curved vane and the discharge wall. The function of the discharge wall is to reinforce and enclose the curved vane, thereby giving strength and rigidity to the discharge means and preventing debris and overspray from adversely affecting the spray traveling on the curved vane. The discharge wall also provides a barrier against which pulp buildup may impact without damaging the curved vane or clogging the spray outlets. Raised guide vanes may be placed upon the curved vane to contain and guide the flow of fluid being dispensed through the reservoir outlets. The raised guide vanes are positioned on the side of each reservoir outlet so as to diverge from the reservoir outlet toward the outer edges of a corresponding spray outlet.

The spray outlets are formed or cut into the juncture between the lower edge of the curved vane and the lower edge of the discharge wall. The openings of the spray outlets are sufficiently large to allow the passage of the fan-shaped fluid spray, but small enough to prevent debris from entering through the openings.

The discharge means may be provided with one or more sets of alternating spray outlets, each set imparting a different spray configuration or pattern, or having a different spray direction. The spray configuration and pattern may be altered by changing the size or configuration of the reservoir outlet, changing the positioning of the guide vanes, or by changing the size of the spray outlet.

The spray direction or angle of application may be altered by changing the orientation of the apparatus with respect to the support frame and receiving surface. Additionally, the spray direction or angle of application may be altered by using a variety of differently formed or cut spray outlets. Thermoplastic or formed insert sections such as raised guide vanes may also be used to give structural strength to the apparatus and direct the flow of fluid traveling from each reservoir outlet toward corresponding spray outlets. The raised guide vanes preferably allow the fluid to spread outward into spray having a fan shaped pattern.

As the fluid leaves the curved vane, exiting through the spray outlet, the fluid generally assumes a spray direction which is tangential to the terminal end of the curved vane. Thus, different terminal ends having different tangential angles would impart different spray directions through their corresponding spray outlets. For example, the openings of one set of spray outlets may be cut further up into the lower end of the curved vane than the openings of another set of spray outlets. Since the vane is curved, a deeper cut will consequently give a terminal end which produces a more downwardly inclined spray direction. In the preferred embodiment, two alternating sets of spray outlets are used, each set having a different spray direction.

A stiffening means may also be provided to give added strength and rigidity to the device to prevent the device from sagging or bending. In the preferred embodiment, the stiffening means is secured to the device near the discharge wall. Appropriate openings are cut into the stiffening means to allow the spray outlets to perform their appropriate functions. So located, the stiffening means adds to the resistive barrier of the discharge wall, giving the device added strength and thickness to withstand an impact against pulp buildup.

One should understand the drawings are not necessarily to scale and the elements are sometimes illustrated by graphic symbols, phantom lines, diagrammatic representations, and fragmentary views. In certain instances, the applicant may have omitted details which are not necessary for an understanding of the present invention or which render other details difficult to perceive.

BEST MODE FOR CARRYING OUT THE INVENTION

Figure 1:
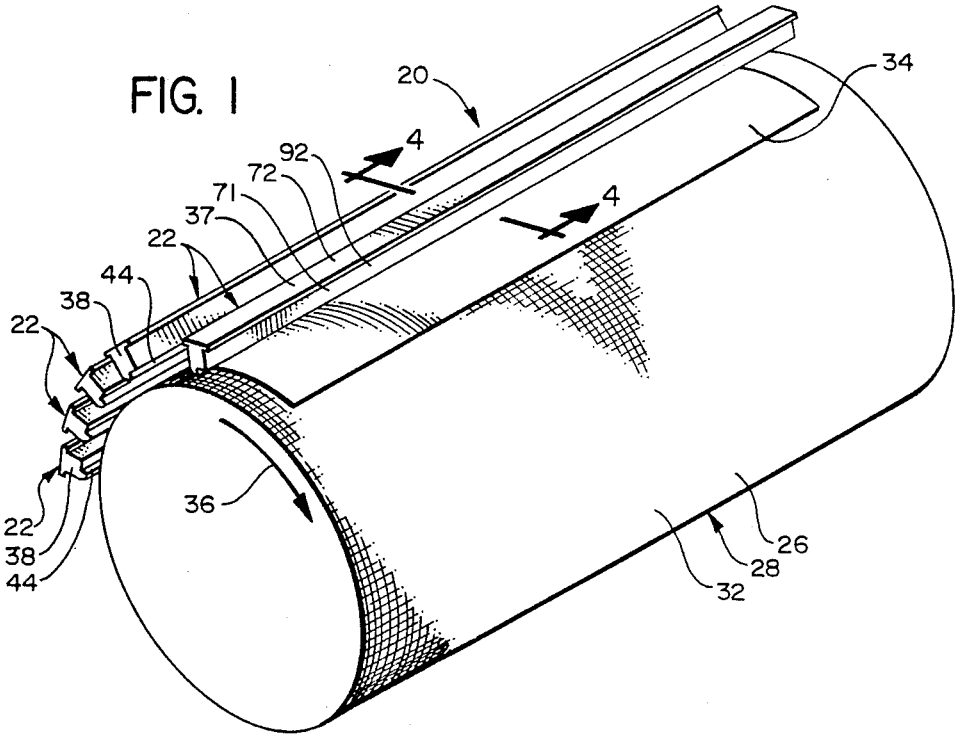
FIG. 1 is a perspective view of the liquid distribution device placed near a rotary drum and pool, as made in accordance with this invention.
Figure 2:
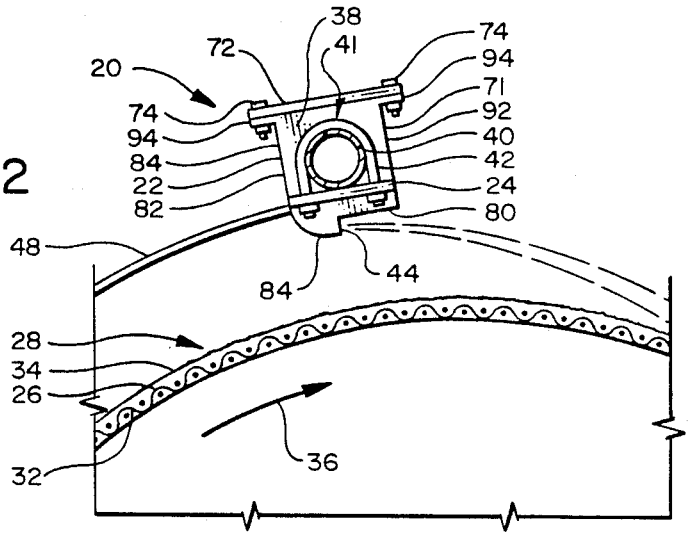
FIG. 2 is a schematic side elevational view of the invention showing the preferred mounting means and orientation of the shower pipe with respect to the rotary drum.
Figure 3:
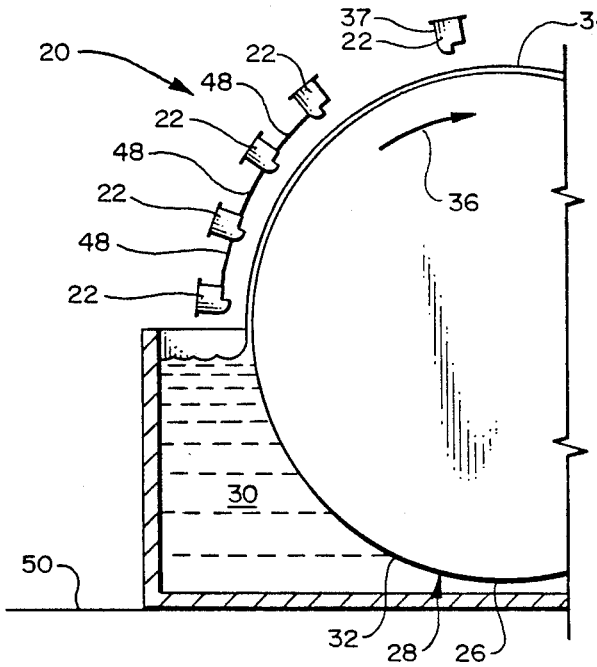
FIG. 3 is a schematic side elevational view of a plurality of shower pipes positioned near the rotary drum and pool.

Referring to the drawings and particularly to FIG. 1, wherein like numerals indicate like parts, a liquid distribution device 20 as taught herein is generally an elongated conduit or shower pipe 22 which may be positioned upon a support framework 24 (a portion of which is shown in FIG. 2) an appropriate distance away from an outer surface 26 of a rotary drum 28. As shown in FIG. 3, drum 28 is partially submerged in a pool 30 of pulp fibers and slurry and is rotated. Outer surface 26 is defined by a filter screen 32. The interior of drum 28 is exposed to a vacuum plenum which causes a mass air flow to pass inwardly into drum 28 through filter screen 32. The mass air flow causes an accumulation of pulp fibers and slurry to be urged against the outer surface of filter screen 32 and thereby create a pulp mat 34. The mass air flow is exhausted in any conventional manner. Pulp mat 34 is carried upon filter screen 32 of rotating drum 28.

As shown in FIGS. 1 and 3, several parallel shower pipes 22 may be used. Use of several shower pipes 22 allows greater spray coverage to be obtained. For example, three to six shower pipes 22 may be angularly spaced around a segment of drum 28, proceeding in the direction of drum rotation 36, to extend from just above the surface of pool 30 to near the top of drum 28. Each shower pipe is preferably spaced apart from each succeeding shower pipe 22 by approximately sixteen (16) to eighteen (18) inches. The uppermost shower pipe 37 should be no closer than approximately eighteen (18) inches from the top of the rotating drum 28. Greater or fewer shower pipes 22 and greater or smaller distances may be used if needed. Shower pipes 22 extend axially along the length of drum 28 and may be supported at their ends 38 and/or at various locations along their length.

In the preferred embodiment, as shown in FIG. 2, each end 38 of shower pipe 22 is provided with a cylindrical or functionally equivalent extension 40. Where a cylindrical conduit or supply line (not shown) is used to supply fluid into shower pipe 22, such cylindrical conduit may also serve as extension 40. Each extension 40 may be adjustably and removably attached to structural support frame 24 by mounting means 41.

Mounting means 41 may comprise a U-bolt type or similar bracket 42. Brackets 42 allow shower pipes 22 to be readily and easily rotated or removed. Rotation of shower pipes 22 within brackets 42 allows the angle at which the fluid spray contacts pulp mat 34 to be adjusted. Applicant has discovered that better spray coverage occurs when shower pipes 22 are positioned with the direction of its spray discharge having a generally tangential orientation with respect to the adjacent surface area of drum 28. With such an orientation, as shown in FIGS. 2 and 3, the resulting spray pattern contacts the moving pulp mat 34 at an adjustable acute angle. A detailed description of the spray pattern will be discussed further below. Brackets 42 also allow removal of shower pipes 22 from support frame 24 should removal for maintenance become necessary.

A plurality of spray outlets 44 are formed into shower pipe 22 to allow a fluid spray to be dispensed therefrom. Support frame 24 enables spray outlets 44 to maintain a fixed radial distance from pulp mat 34. The preferable distance between spray outlets 44 and pulp mat 24 is approximately four (4) to six (6) inches.

A splash shield 48, shown in FIGS. 2 and 3, may be placed between each of the successively spaced shower pipes 22 to prevent splash-back material from escaping containment and to direct the splash-back material downward into pool 30. Splash shields 48 increase the safety of device 20 by maintaining a drier environment around a base 50 of device 20.

For convenience in discussion, the present invention is divided into two main features: a reservoir means 52, and a discharge means 54. Reservoir means 52 receives and distributes the fluid throughout the length of shower pipe 22. Discharge means 54 dispenses the stored fluid and controls the pattern and direction of the dispensed spray.

Shower pipe 22 may be initially and integrally formed with plastic or fiberglass reinforced plastic. This may be done through extrusion molding, contact molding, vacuum formed, or the like. Alternatively, the unit can be fabricated of stainless steel, mild steel, or other steel or metal alloys.

It is important to note that the present invention may incorporate various different methods and elements to control fluid distribution within reservoir means 52 and to control the discharge and spray pattern of the liquid being dispensed from discharge means 54. Each of these methods and their corresponding elements will be now explained, followed by a detailed explanation of the particular structure of the preferred embodiment.

The first method of controlling the fluid and hydraulic pressure located within reservoir means 52 is to use a controlled hydraulic pump (not shown) which supplies fluid into shower pipe 22 at a constant, controlled, and regulated rate. Once the fluid has entered shower pipe 22, the fluid is stored within reservoir means 52.

The second method of controlling the fluid and hydraulic pressure located within reservoir means 52 is to use appropriately placed baffle mechanisms 58 to partition reservoir means 52 into a plurality of smaller reservoirs. The fluid is required to pass around or through baffle mechanisms 58 before dispensing occurs. For example, in the preferred embodiment, reservoir means 52 comprises a first and a second reservoir 60 and 62 which are divided by baffle mechanism 58. .As the fluid enters shower pipe 22, the fluid is distributed throughout first reservoir 60. Passage of the fluid into second reservoir 62 is restricted by baffle mechanism 58. The fluid must pass through or around baffle mechanism 58 before entering second reservoir 62. Consequently, baffle mechanism 58 causes a more even distribution of the fluid and associated hydraulic pressures throughout the length of second reservoir 62. Other benefits such as added strength and rigidity suggest the use of baffle mechanism 58.

The third method of controlling the fluid and hydraulic pressure located within reservoir means 52 is to control the flow of fluid exiting second reservoir 62. To achieve this, uniform orifices, discharge openings or reservoir outlets 64 are placed at designated, spaced intervals along the length of shower pipe 22 within second reservoir 62. The fluid passing through each reservoir outlet 64 has a substantially equal rate of discharge, velocity, consistency, and thickness.

Discharge means 54 comprises: reservoir outlets 64 and a reinforced, enclosed curved vane 66 which is arranged to provide two or more sets of spray outlets 44 and 44'. Discharge means 54 may also comprise a discharge wall 68 which serves as a reinforcing structure and reduces spray back against curved vane 66. Where discharge wall 68 is used, spray outlets 44 and 44' are formed or cut into the juncture where curved vane 66 meets discharge wall 68.

Reservoir outlets 64 serve a dual purpose: to control the hydraulic pressure located within reservoir means 52, and to control the flow or application rate and spray configuration of the fluid passing from reservoir means 52 into discharge means 54. As the fluid is being discharged from second reservoir 62, reservoir outlets 64 cause the fluid passing therefrom to fan out against curved vane 66 placed beneath each reservoir outlet 64. Curved vane 66 receives and redirects the fluid flow toward spray outlets 44.

Figure 6:
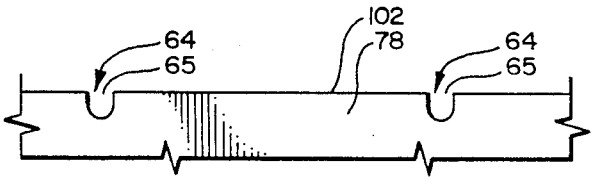
FIG. 6 is a partial plan view of two reservoir outlets formed in the volume control plate.
Figure 8:
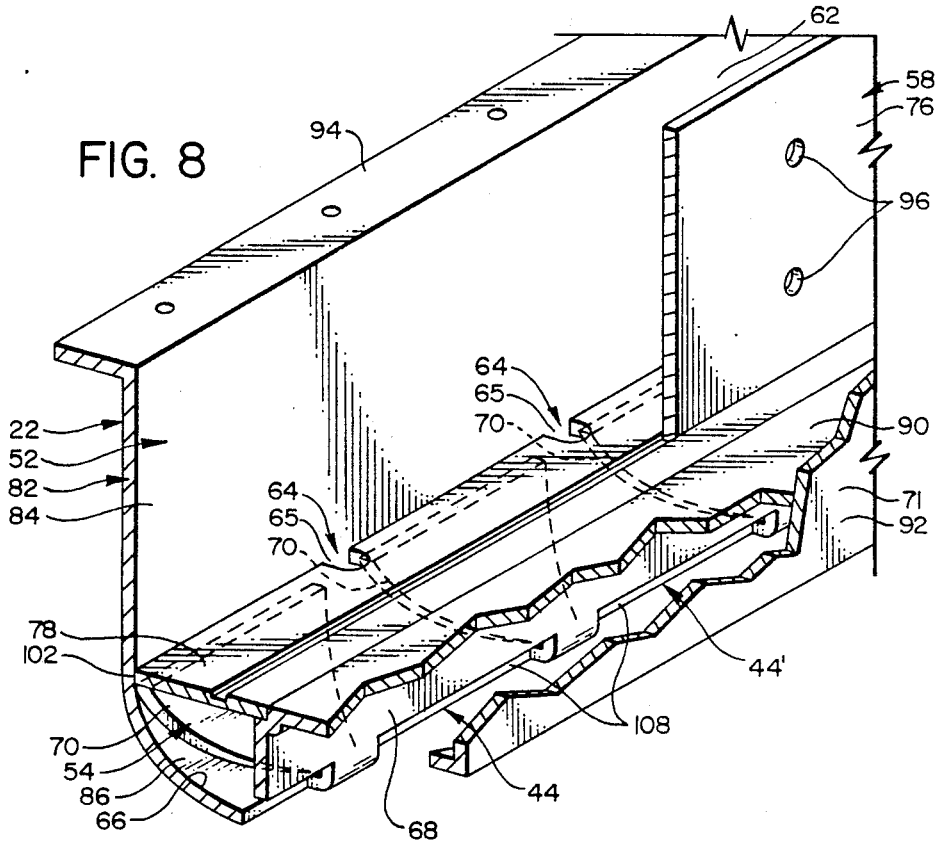
FIG. 8 is a schematic perspective view of the volume control plate, curved vane, raised guide vanes, elevated reservoir floor, and seating means.
Figure 11:
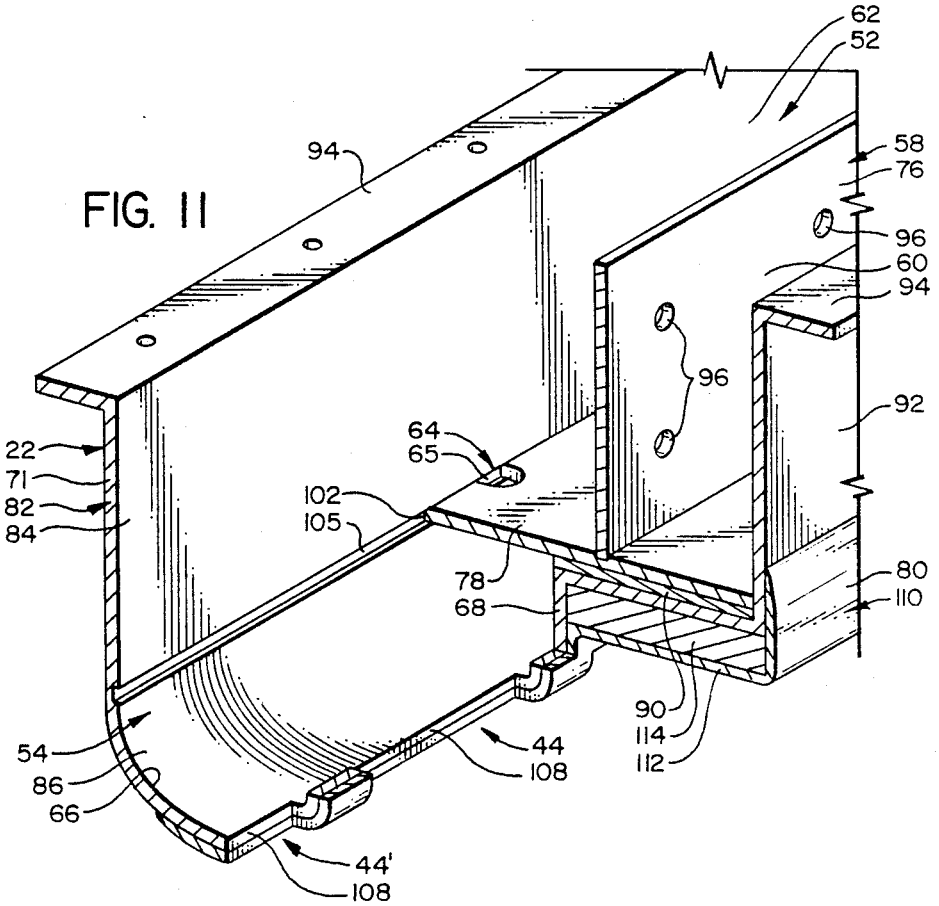
FIG. 11 is a partial perspective view of the embodiment shown in FIGS. 9 and 10 illustrating how the stiffening means is attached to the conduit.

The configuration of each reservoir outlet 64 has a significant effect on the spray pattern of the dispensed liquid. For example, the shape of an outlet significantly affects the location and intensity of eddies occurring within the fluid flow, the amount of overspray which may occur, and the amount of debris which may accumulate about the edges of the outlet. In the preferred embodiment as shown in FIGS. 6, 8 and 11, reservoir outlets 64 have a "D" shape with the truncated straight edge portion 65 of the shape being located nearest curved vane 66. Such a design causes the fluid to assume a fan shape as the fluid contacts curved vane 66. Each reservoir outlet 64 is defined by a semi-circular edge portion of related cutouts formed at the rear edge of a discharge plate or volume control plate 78. This design has the added benefit of being relatively easy and inexpensive to manufacture.

Curved vane 66 is an enclosed, reinforced, curved structure which directs the dispensed fluid toward a plurality of spray outlets 44 formed in shower pipe 22. The enclosure of curved vane 66 provides device 20 added strength and rigidity to resist sagging, to withstand an impact against an accumulation of pulp buildup, and to resist abrasion against such pulp buildup. The enclosure of curved vane 66 also greatly reduces the susceptibility of device 20 from becoming clogged by an accumulation of excess liquid or debris being splashed back upon curved vane 66 or around spray outlets 44.

Figure 4:
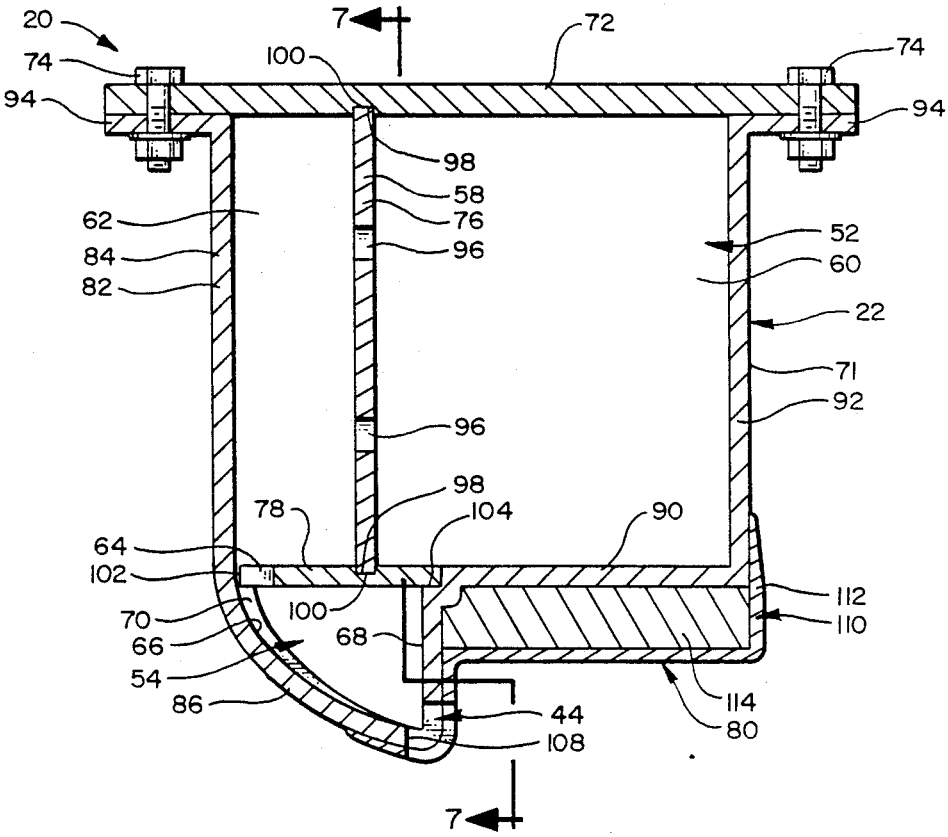
FIG. 4 is a side elevational view of the shower pipe as taken along line 4—4 of FIG. 1, with only one spray outlet being shown.
Figure 7:
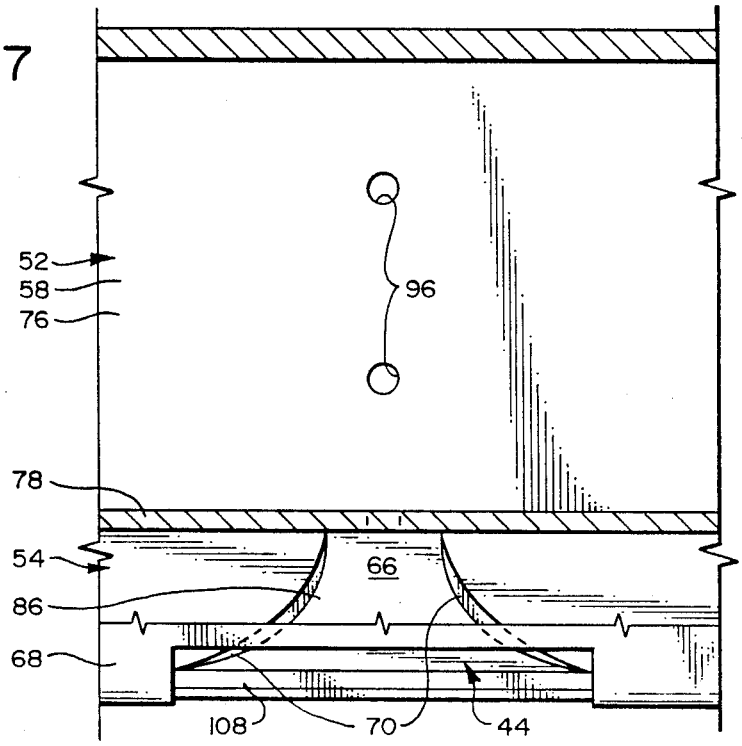
FIG. 7 is a partial side elevational view of the first and second set of spray outlets and the raised guide vanes as taken along line 7—7 of FIG. 4.

As shown in FIGS. 4, 7 and 8, ridges or raised guide vanes 70 may be provided on curved vane 66 to direct the passage of the fluid flow through discharge means 54. Raised guide vanes 70 may also be used to restrict fluid dispensed from one reservoir outlet from interfering with the fluid being dispensed from an adjacent reservoir outlet. Preferably, however, the fluid passes along curved vane 66 without ever contacting raised guide vanes 70.

Spray outlets 44, as illustrated in FIGS. 4, 7, 9, 10 and 11, are formed or cut from the enclosure of curved vane 66 near a lower downstream end of curved vane 66. Spray outlets 44 are appropriately dimensioned to allow passage of the fanned spray without having the spray contact the sides or upper edge of the spray outlets 44. In this way, spray outlets 44 do not impinge upon the flow or passage of the fluid and do not cause additional eddies within the fluid. Spray outlets 44 should, however, be sufficiently small to restrict back-wash or debris from passing back into discharge means 54.

Figure 10:
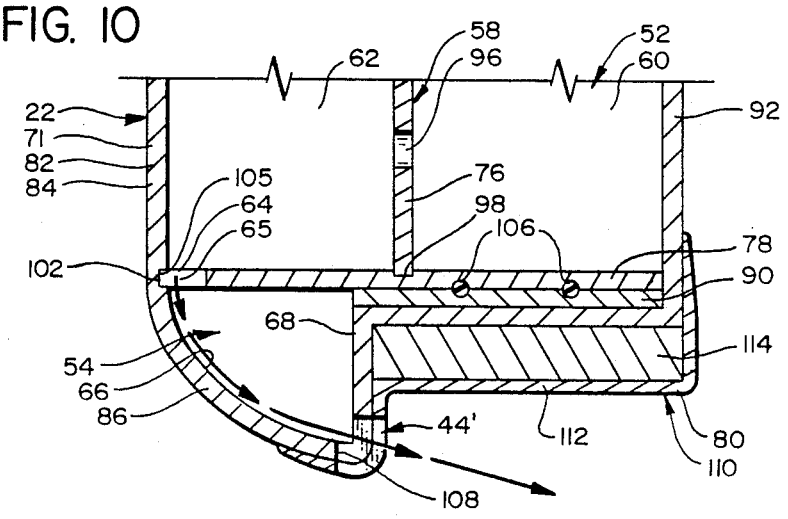
FIG. 10 is a side elevational view of the embodiment shown in FIG. 9 except that the fluid flow path is indicated as passing through the second set of spray outlets.
Figure 9:
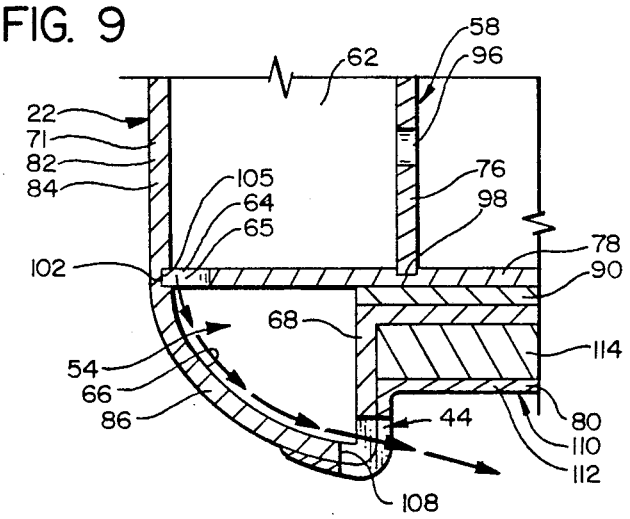
FIG. 9 is a side elevational view of a second embodiment of the present invention indicating the fluid flow path through the first set spray outlets.

In the preferred embodiment, the invention uses two different sets of staggered spray outlets 44 and 44'. Please compare FIG. 9 with FIG. 10. The first set of spray outlets 44, shown in FIG. 9, are created by forming or cutting alternating openings into shower pipe 22 near the lower end of the enclosed curved vane 66. The second set of spray outlets 44', shown in FIG. 10, are similarly created and are positioned at stepped intervals between the respective openings of the first set of spray outlets 44. A significant difference between the first and second set of spray outlets 44 and 44', however, is that the second set of spray outlets 44' are cut into curved vane 66 further upstream from the first set of spray outlets 44. The fluid exits each spray outlet 44 and 44' along a line which is generally tangential to the interior surface of curved vane 66 at the location from which the fluid is leaving. The first set of spray outlets 44 causes the fluid to exit discharge means 54 in a first direction which is substantially tangential to a first terminal end of curved vane 66. The second set of spray outlet 44' causes the fluid to exit discharge means 54 in a second direction which is substantially tangential to a second terminal end of curved vane 66. The tangential angle of the first terminal end corresponding to spray outlets 44 with respect to the rotating pulp mat is different than the tangential angle of the second terminal end corresponding to spray outlets 44'. The result of alternating the first and second set of spray outlets 44 and 44' is a uniform, somewhat staggered, and overlapping spray pattern which extends substantially the entire length of shower pipe 22.

Reservoir outlets 64, reinforced curved vane 66, and spray outlets 44 and 44' all significantly contribute to cause the spray from shower pipe 22 to be dispensed with a substantially equal rate of application, velocity, pressure, consistency and thickness along the length of shower pipe 22. The structural elements of the preferred embodiment will now be explained.

At first glance, shower pipe 22 appears to be made from elongated structural tubing having a generally rectangular, cross-sectional configuration. In fact, in the preferred embodiment, shower pipe 22 comprises the combination of: a conduit 71; a cover 72; fastening means 74; a seal compression leg 76; a volume control plate 78; a series of raised guide vanes 70; and stiffening means 80. In general terms, each of these elements serve the following purposes. Conduit 71 contains the fluid. Cover 72 is attached to conduit 71 with fastening means 74, thereby confining the fluid within shower pipe 22. Volume control plate 78 defines the boundary between reservoir means 52 and discharge means 54, reservoir outlets 64 being located within volume control plate 78. Volume control plate 78 is held in place by compression leg 76 which is juxtaposed between volume control plate 78 and cover 72. A more detailed description will now be given.

Conduit 71 comprises the following integral elements a rear wall 82 having a generally straight upper portion 84 and a curved lower portion 86; a lower, generally straight discharge wall 68; an elevated conduit floor 90; and a generally straight front wall 92. Upper portion 84 is substantially parallel to front wall 92, compression leg 76, and discharge wall 68. Cover 72 and conduit floor 90 are substantially perpendicular to upper portion 84. Rear wall 82 is integrally connected to curved lower portion 86 which in turn is integrally connected to discharge wall 68. Discharge wall 68 is integrally connected to conduit floor 90, and conduit floor 90 is integrally connected to front wall 92. Volume control plate 78 and conduit floor 90 define a reservoir floor of reservoir means 52.

Cover 72, upper portion 84, volume control plate 78, conduit floor 90, and front wall 92 form reservoir means 52 and impart a generally square or rectangular cross-section to conduit 71. One end of conduit 71 may be sealed and the other end provided with a supply line appropriately communicating a supply of fluid to reservoir means 52 from hydraulic pump 56. Alternatively and preferably, fluid is supplied to reservoir means 52 through supply lines located at both ends of conduit 71 and/or at other locations along the length of conduit 71.

Cover 72 may be removably secured to conduit 71. For example, upper portion 84 and front wall 92 may be provided with outwardly extending flanges 94 to which cover 72 may be attached. Cover 72 spans across and seals the distance between the upper edges of upper portion 84 and the upper edges of front wall 92. Fastening means 74, such as a nut and bolt fastener or similar device, fastens cover 72 to flanges 94.

Figure 5:
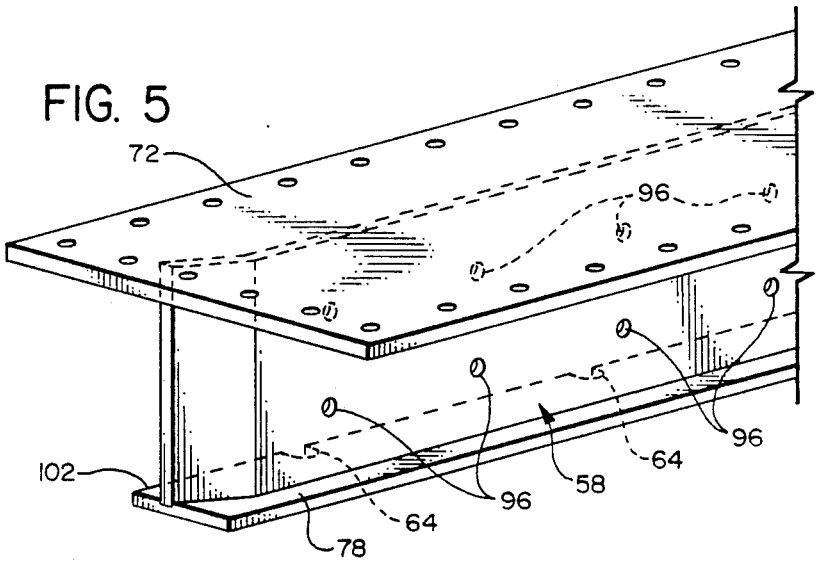
FIG. 5 is a partial perspective view of the cover, seal compression leg, and volume control plate with a portion of the compression leg cut away to show a reservoir outlet.

Compression leg 76 serves as baffle mechanism 58 dividing first reservoir 60 from second reservoir 62. Compression leg 76 has a plurality of perforations 96 or orifices made therein. Fluid passes through perforations 96 to travel from first reservoir 60 into second reservoir 62. Compression leg 76 may also serve to secure volume control plate 78 in place between reservoir means 52 and discharge means 54. During operation of device 20, compression leg 76 is held in a fixed position. Securement may be accomplished by attaching compression leg 76 to cover 72 and/or to volume control plate 78. Alternatively, an alignment means 98, such as slots or grooves within cover 72 and/or volume control plate 78 into which compression leg 76 may be fitted, may be used to maintain the position of compression leg 76. The terminal ends 100 of compression leg 76 may be juxtaposed against ends 38 of shower pipe 22 to prevent escape of fluid around ends 100. Ends 100 may also be angled as shown in FIG. 5 to give added support and strength to compression leg 76 and shower pipe 22. Added bracing or angling of compression leg 76 may be used if needed.

Volume control plate 78 is positioned between reservoir means 52 and discharge means 54. Volume control plate 78 has a rear portion 102 located adjacent rear wall 82. A plurality of holes, openings, or reservoir outlets 64 are formed into rear portion 102 such that reservoir outlets 64 are substantially adjacent to the interior curved surface of curved lower portion 86. Fluid is directed through reservoir outlets 64 from second reservoir 62 toward lower portion 86. Lower portion 86 serves as a spillway or curved vane to direct the fluid way from reservoir outlets 64 for dispensing onto pulp mat 34.

Cover 72, baffle mechanism 58, and volume control plate 78 can be easily removed to allow easy access to the interior of reservoir means 52. Such access might become necessary to clean out reservoir means 52 if the upstream filtration system malfunctions allowing fibers and/or knots pass into reservoir means 52. Shower malfunction might occur if such an event occurred and either reservoir outlets 64 and/or spray outlets 44 became plugged. Ends 38 may also be removable or specially designed to allow for easy access or back-flushing of device 20. For example, each end 38 may be provided with a thermoplastic, stainless steel, or the like, connection that will facilitate back-flushing or cleaning if uncontrollable upstream contamination occurs. The connection may comprise an inlet of approximately three-fourth ($\frac{3}{4}$) of an inch in diameter which can be plugged or capped during normal operation of device 20.

As explained above and as shown in FIGS. 6 and 8, reservoir outlets 64 preferably have a "D" configuration with the curved portion of the outlet being positioned away from rear wall 82. The "D" shape gives the resulting fluid spray a fanned configuration. Alternatively, other configurations such as elongated slots or circular bore holes may be used. Reservoir outlets 64 are placed at spaced intervals along the length of shower pipe 22. In the preferred embodiment, the spacing of reservoir outlets 64 is along approximately eight (8) inch centers.

As shown in FIG. 4, volume control plate 78 may be seated into seating means 104. Seating means 104 may be formed into conduit 71 along the juncture between discharge wall 68 and conduit floor 90, and/or between the juncture between upper portion 84 and lower portion 86. Volume control plate 78 may additionally and/or alternatively rest upon the upper edges of a plurality of raised guide vanes 70 which in turn are attached to curved lower portion 86. Within a second embodiment shown in FIGS. 9 through 11, volume control plate 78 overlies conduit floor 90. A slot 105 is provided along the juncture between upper portion 84 and lower portion 86 into which a rearward edge of volume control plate 78 is inserted for support. Volume control plate 78 is held in place by its location within slot 105 and by it being urged against conduit floor 90 by compression leg 76. "O"-rings 106 or other sealant material may also be used as shown in FIG. 10.

Volume control plate 78, lower portion 86, and discharge wall 68 define the boundaries of discharge means 54. Lower portion 86 serves as a spillway or curved vane 66 which has been previously discussed. Lower portion 86 extends downwardly from a lower end of upper portion 84 located adjacent to volume control plate 78. So extending, lower portion 86 curves through approximately a ninety (90) degree turn to join a lower edge of discharge wall 68. A variety of different curves may be used, but a substantially ninety (90) degree curve is preferred. A portion of curved vane 66 is flattened out slightly near its termination points located directly adjacent spray outlets 44 and 44'.

The juncture of lower portion 86 and discharge wall 68 defines a lower forward edge of curved vane 66. This juncture extends along the entire length of conduit 71 except for portions of the juncture which have been cut away at appropriate intervals to form spray outlets 44. As explained above, two or more alternating sets of spray outlets 44 and 44' are preferably used.

Discharge wall 68 is an integral part of conduit 71 and gives structural strength and rigidity to lower portion 86. Discharge wall 68 serves to support lower portion 86 during operation of device 20. This is particularly true when device 20 impacts against an accumulation of pulp buildup. In the preferred embodiment, a lower forward edge 108 of curved lower portion 86 is located a moderate distance below conduit floor 90 with discharge wall 68 traversing the distance therebetween. The height of discharge wall 68 is preferably about one and three-fourths ($1\frac{3}{4}$) of an inch. Other heights, such as a one inch height, have also been used successfully.

Spray outlets 44 and 44' serve as discharge slots or nozzles through which the fluid is expelled from device 20. Spray outlets 44 and 44' of the present invention are formed or cut from lower forward edge 108 and from discharge wall 68. The height of spray outlets 44 and 44' along discharge wall 68 should be high enough to allow the fluid to escape discharge means 54 without contacting the upper edges of the spray outlets, but yet small enough to prevent contaminants from entering discharge means 54.

In the preferred embodiment, the height of spray outlets 44 and 44' are approximately three-fourths ($\frac{3}{4}$) of an inch. Similarly, the width of spray outlets 44 and 44' should be of sufficient length to permit the fluid to escape discharge means 54 without contacting the side edges of the spray outlets.

The primary difference between spray outlets 44 and spray outlets 44' lies in the depth of each outlet and the tangential angle each has with respect to curved lower portion 86 and to each other. As shown in FIG. 9, first set of spray outlets 44 discharge the fluid in a direction substantially more parallel to the orientation of conduit floor 90 than occurs with spray outlets 44'. Similarly, as shown in FIG. 10, second set of spray outlets 44' are cut further back into curved vane 66 to discharge the fluid in a direction more downwardly inclined than that of the spray exiting spray outlets 44. These two sets of spray outlets 44 and 44' are staggered with respect to one another so that the fluid spray exiting therefrom has a somewhat staggered, overlapping flow pattern. In the preferred embodiment, the edges of spray outlets 44 and 44' maintain fixed positions on discharge wall 68. The staggered effect is caused by the varying placement of the edges of spray outlets 44 and 44' which are located on curved vane 66. Where one set of spray outlets remains generally fixed, and the other set of spray outlets is positioned either inward or outward along curved vane 66 in relation to the fixed set of spray outlets.

To assure the fluid does not contact the outer sides of each spray outlet 44 and 44', which would cause adverse turbulence within the fluid flow and possibly cause an accumulation of fluid about the outlets to occur, raised guide vanes 70 or gullies may be formed or used within discharge means 54. Raised guide vanes 70 are positioned along curved lower portion 86 to restrict excessive expansion of the fan-shaped spray being created by reservoir outlets 64 and curved vane 66. In the preferred embodiment, raised guide vanes 70 are placed to diverge from one another in a downstream direction from respective reservoir outlets 64. Raised guide vanes 70 may take the form of curved triangular stiffeners. Raised guide vanes 70 preferably tapers in thickness from approximately three-eighths (⅜) of an inch thickness near volume control plate 78 to a three-sixteenth (3/16) of an inch thickness near discharge wall 68. Raised guide vanes 70 traverse curved lower portion 86 from adjacent volume control plate 78 and within approximately one-fourth (¼) of an inch to each side of a reservoir outlet 64 to the outer side edges of corresponding spray outlets 44 or 44'. In effect, raised guide vanes 70 act as a control to confine the flow of fluid within an expanding fan-shaped pattern toward spray outlets 44 or 44'. Although use of raised guide vanes 70 are not required, such use performs the mentioned function and adds to the rigidity of shower pipe 22.

An additional and optional feature of the present invention is the use of stiffening means 110 which may be incorporated into shower pipe 22 to provide added resistance to deflection of conduit 71. Use of stiffening means 110 is especially beneficial for shower pipes 22 whose length is in excess of sixteen (16) feet. Stiffening means 110 may take the form of an elongated support overlay which is attached conduit 71. In the preferred embodiment, stiffening means 110 is an added overlay support structure 112 which is attached to the outer areas of lower portion 86, discharge wall 68, conduit floor 90, and front wall 92. Overlay support structure 112 has a thickness of approximately three-sixteenths (3/16) of an inch. Appropriate openings are formed or cut into stiffening means 110 near spray outlets 44 and 44' to allow spray outlets 44 and 44' to serve their proper function. Overlay support structure 112 may be provided with a filler support material 114 for additional structural strength.

During use, fluid is fed into shower pipe 22 through an appropriate opening in one or both ends 38 of shower pipe 22. Upon entering, the fluid passes into a reservoir means 52 of shower pipe 22. Reservoir means 52 may comprise one or more reservoirs. Where two reservoirs are used, the fluid is initially passed into a first reservoir 60 whereupon the fluid is evenly distributed along the interior length of shower pipe 22. The fluid is then required to pass around or through a baffle mechanism 58 to enter a second reservoir 62 from which the liquid it dispensed through a plurality of reservoir outlets 64. Reservoir outlets 64 cause the resulting liquid spray to assume a fan-shaped configuration. An enclosed, reinforced, curved vane 66 receives and redirects the fluid spray toward a plurality of spray outlets 44 or 44'.

Various spray angles may be obtained by causing the fluid spray to exit curved vane 66 at different termination points or lengths along the length of curved vane 66. The fluid spray is then directed toward a receiving surface.

The means and construction disclosed herein comprise primarily the preferred form of putting the invention into effect. Although the drawings depict a preferred and alternative embodiment of the invention, other embodiments have been described within the preceding text. One skilled in the art may appreciate that the disclosed device may have a wide variety of shapes and configurations. Additionally, persons skilled in the art to which the invention pertains might consider the foregoing teachings in making modifications or other embodiments of the invention.

It is, therefore, to be understood that the invention is not limited to the embodiments or specific features shown herein. Applicant claims the invention in all of its forms, including all alternatives, modifications and embodiments within the legitimate and valid scope of the appended claims, appropriately interpreted under the Doctrine of Equivalents.

INDUSTRIAL APPLICABILITY

This improved liquid distribution device may be used to evenly dispense a controlled, continuous thin sheet of liquid spray, having a substantially equal rate of application, velocity, pressure, consistency, and thickness, across a width of a rotary drum. The resulting liquid spray so provided has a uniform, somewhat staggered and overlapping spray pattern. Another significant benefit of the present invention over the prior art is the teaching of the use of a reinforced, enclosed, curved vane and plurality of uniquely designed spray outlets which significantly resist breakage when impacted against a pulp buildup and prevent debris from disrupting the aforesaid spray pattern.

I claim:

1. An apparatus for spraying a fluid onto a surface comprising:

(a) reservoir means for containing and dispensing said fluid, said reservoir means having an inlet and a plurality of reservoir outlets; and (b) discharge means for controlling a rate of discharge, spray configuration, and angle of application of said fluid being sprayed onto said surface, said discharge means communicating with said reservoir means through said reservoir outlets, said discharge means having a reinforced, enclosed, curved vane and a discharge wall, a lower end of said curved vane and a lower end of said discharge wall being integrally connected along a juncture, a plurality of spray outlets being formed along said juncture, said fluid being dispensed from said reservoir means onto said curved vane, said curved vane redirecting said fluid outward of said discharge means through said spray outlets.

2. The apparatus of claim 1, wherein said reservoir means comprises:

(a) an elongated conduit;

(b) an elongated cover removably attached to said conduit, said cover and said conduit defining an enclosure;

(c) fastener means for removably attaching said cover to said conduit;

(d) a removable volume control plate placed within said enclosure between said reservoir means and said discharge means, said volume control plate having said plurality of said reservoir outlets formed therein to permit a controlled discharge of said fluid from said reservoir means into said discharge means, said conduit having seating means whereby said volume control plate may be securely positioned within said enclosure;

(e) a seal compression leg for securing said volume control plate against said seating means, said compression leg being secured between said cover and said volume control plate; and (f) alignment means to maintain position of said compression leg between said cover and said volume control plate.

3. The apparatus of claim 1, wherein said discharge means further comprises a plurality of guide vanes secured to said curved vane, said guide vanes controlling a spray configuration of said fluid dispensed from said discharge means through said spray outlets.

4. The apparatus of claim 1, further comprising stiffening means secured to said discharge means for providing added strength and rigidity to resist deflection of said apparatus.

5. An apparatus for spraying a fluid onto a receiving surface comprising:

a. reservoir means for containment of said fluid, said reservoir means having a plurality of spaced reservoir outlets;

b. discharge means for spraying said fluid onto said receiving surface, said discharge means communicating with said reservoir means through said reservoir outlets, said fluid being dispensed from said reservoir means into said discharge means through said reservoir outlets, said discharge means having a curved vane for receiving and redirecting said dispensed fluid, said curved vane being capable of directing said fluid from said discharge means in a plurality of different directions, each of said directions being generally tangential to said curved vane near corresponding forward edges of said curved vane, said corresponding forward edges defining a plurality of spray outlets; and c. said discharge means further comprising a discharge wall, said curved vane traversing between near said reservoir outlet and near said discharge wall, said discharge means having said plurality of spray outlets formed therein near a juncture of said curved vane and said discharge wall.

6. The apparatus of claim 5, wherein an interior of said discharge means is enclosed, said curved vane being reinforced by structure of said enclosure.

7. The apparatus of claim 6, wherein said interior of said discharge means is enclosed within said curved vane, said discharge wall and said reservoir means.

8. An apparatus for spraying a fluid onto a receiving surface comprising:

a. reservoir means defining a reservoir area for containment of said fluid, said reservoir means having a plurality of spaced reservoir outlets;

b. discharge means for spraying said fluid onto said receiving surface, said discharge means communicating with said reservoir means through said reservoir outlets, said fluid being dispensed from said reservoir means into said discharge means through said reservoir outlets;

c. said reservoir means comprising an elongated conduit having a removable volume control plate, said volume control plate being positioned between said reservoir means and said discharge means, said reservoir outlets being located within said volume control plate; and d. said conduit having a rear wall, a front wall, and a conduit floor, said conduit being integrally connected to said discharge portion, said rear wall being integrally connected to a curve vane, said curved vane being integrally connected to a lower discharge wall portion which is integrally connected to said conduit floor, said conduit floor being integrally connected to said front wall, said volume control plate and said conduit floor defining a reservoir floor of said reservoir means.

9. The apparatus of claim 8, wherein said reservoir means further comprises seating means whereby said volume control plate may be secured in position.

10. The apparatus of claim 9, wherein said seating means comprises at least one O-ring.

11. The apparatus of claim 9, further comprising a cover and a seal compression leg for securing said volume control plate against said seating means, said compression leg being secured between said cover and said volume control plate, said cover and said volume control plate having alignment means to maintain position of said compression leg, said compression leg having a plurality of perforations therein.

12. An apparatus for spraying a fluid onto a receiving surface, such as a surface of a rotating drum, said apparatus comprising:

a. an upper reservoir means defining a reservoir to contain said fluid and having opening means to discharge said fluid;

b. a lower discharge means having a lengthwise axis and having a substantially unitary vane means which has a substantially continuous vane surface extending along said lengthwise axis, said vane surface having a first lengthwise extending upstream portion positioned to receive fluid flow from said opening means and a lengthwise extending downstream portion positioned to discharge said fluid which flows from said upstream portion over said vane surface and outwardly from said downstream portion.

c. said downstream portion having a first set of first end edge discharge sections positioned on said vane surface closer to the upstream portion and a second set of second end edge discharge sections which are positioned further from said upstream portion intermittently with said first end edge sections in a manner that first fluid portions flowing over said first end edge sections are discharged along a first lengthwise extending discharge region, and second fluid portions flowing over said second end edge sections are discharged along a second lengthwise extending discharge region which is spaced upwardly from said first discharge region.

13. The apparatus as recited in claim 12, wherein said vane surface is curved from said upstream portion to said downstream portion so that said first and second fluid portions, flowing tangentially from said first and second end edge sections, respectively, are directed at angularly spaced directions from one another.

14. The apparatus as recited in claim 13, wherein there is structural wall means connecting between said downstream portion of said vane means at least on opposite sides of said second end edge sections, and also connecting to main structure of said apparatus.

15. The apparatus as recited in claim 12, wherein there is structural wall means connecting between said downstream portion of said vane means at least on opposite sides of said second end edge sections, and also connecting to main structure of said apparatus.

16. The apparatus as recited in claim 12, wherein said reservoir means has at least front and rear walls defining at least a portion of said reservoir, a removable discharge plate means positioned at a lower part of said reservoir and containing discharge openings leading from said reservoir to the upstream portion of said vane surface, said apparatus having removable plate means which can be removed to provide access to said discharge plate means so that said discharge plate means can be substituted with a second discharge plate means having a differing discharge opening configuration.

17. The apparatus as recited in claim 16, further comprising removable baffle means separating said reservoir into first and second reservoir sections, said apparatus having main fluid inlet means leading into said first reservoir section, said baffle means having baffle opening means extending along a lengthwise axis of said baffle means and leading from said first reservoir section to said second reservoir section.

18. The apparatus as recited in claim 17, wherein said removable plate means comprises a removable top cover means positioned above an upper edge of said baffle means and defining an upper portion of said reservoir, said cover means being removable so that said baffle means and said discharge plate means can be removed from said apparatus.

19. The apparatus as recited in claim 16, wherein said discharge openings are formed as a plurality of cutouts at a rear edge portion of said discharge plate means, the rear edge portion of said discharge plate means fitting against a forward facing rear surface portion of said apparatus that is positioned above and aligned with the upstream surface portion of said vane surface, said discharge openings being defined in part by cutout surface portions of said rear edge portion of the discharge plate means and adjacent regions of said forward facing rear surface portion of said apparatus, in a manner that each of said discharge openings has a rear edge surface portion extending along and above the upstream portion of the vane surface so that fluid flow through said discharge openings along the rear edge of the discharge openings flow immediately onto said upstream surface portion of the vane surface so as to better enable the fluid flow through each of said discharge openings to spread laterally over said vane surface toward said downstream portion of the vane surface.

20. The apparatus as recited in claim 19, wherein the cutouts in the rear edge of the discharge plate means have a substantially concave curved configuration.

21. The apparatus as recited in claim 20, wherein each of said discharge openings has a substantial "D" configuration.

22. The apparatus as recited in claim 12, wherein there is guide vane means positioned on said vane surface on opposite sides of openings of said opening means and defining flow areas on said vane surface that flare outwardly in a downstream direction.

23. The apparatus for spraying a fluid onto a receiving surface, such as a surface of a rotating drum, said apparatus comprising:

a. an upper reservoir means defining a reservoir to contain said fluid and having opening means to discharge said fluid;

b. a lower discharge means having vane means to receive fluid flow from said opening means and to discharge said fluid;

c. said reservoir means having at least front and rear walls defining at least a portion of said reservoir, a removable discharge plate means positioned at a lower part of said reservoir and containing discharge openings leading from said reservoir to an upstream portion of a vane surface of said vane means, said apparatus having removable plate means which can be removed to provide access to said discharge plate means so that said discharge plate means can be substituted with a second discharge plate means having a differing discharge opening configuration.

24. The apparatus as recited in claim 23, further comprising removable baffle means separating said reservoir into first and second reservoir sections, said apparatus having main fluid inlet means leading into said first reservoir section, said baffle means having baffle opening means extending along a lengthwise axis of said baffle means and leading from said first reservoir section to said second reservoir section.

25. The apparatus as recited in claim 24, wherein said removable plate means comprises a removable top cover means positioned above an upper edge of said baffle means and defining an upper portion of said reservoir, said cover means being movable so that said baffle means and said discharge plate means can be removed from said apparatus.

26. The apparatus as recited in claim 23, wherein said discharge openings are formed as a plurality of cutouts at a rear edge portion of said discharge plate means, the rear edge portion of said discharge plate means fitting against a forward facing rear surface portion of said apparatus that is positioned above and aligned with the upstream surface portion of said vane surface, said discharge openings being defined in part by cutout surface portions of said rear edge portion of the discharge plate means and adjacent regions of said forward facing rear surface portion of said apparatus, in a manner that each of said discharge openings has a rear edge surface portion extending along and above the upstream portion of the vane surface so that fluid flow through said discharge openings along the rear edge of the discharge openings flows immediately onto said upstream surface portion of the vane surface so as to better enable the fluid flow through each of said discharge openings to spread laterally over said vane surface toward said downstream portion of the vane surface.

27. The apparatus as recited in claim 26, wherein the cutouts in the rear edge of the discharge plate means have a substantially concave curved configuration.

28. The apparatus as recited in claim 27, wherein each of said discharge openings has a substantial "D" configuration.

29. An apparatus for spraying a fluid onto a receiving surface, such as a surface of a rotating drum, said apparatus comprising:

a. an upper reservoir means defining a reservoir to contain said fluid and having opening means to discharge said fluid;

b. a lower discharge means having a vane means to receive fluid flow from said opening means and to discharge said fluid;

c. said reservoir means having a discharge plate means positioned at a lower part of said reservoir and containing discharge openings leading from said reservoir to an upstream portion of a vane surface of said vane means, said discharge openings being formed as a plurality of recesses at a rear edge portion of said discharge plate means, the rear edge portion of said discharge plate means meeting a forward facing rear surface portion of said apparatus that is positioned above and aligned with the upstream surface portion of said vane surface, said discharge openings being defined in part by recess surface portions of said rear edge portion of the discharge plate means and adjacent regions of said forward facing rear surface portion of said apparatus in a manner that each of said discharge openings has a rear surface portion extending along and above the upstream portion of the vane surface so that fluid flow through said discharge openings along the rear edge of the discharge openings flow immediately onto said upstream surface portion of the vane surface so as to better enable the fluid flow through each of said discharge openings to spread laterally over said vane surface toward said downstream portion of the vane surface.

30. The apparatus as recited in claim 29, wherein the recesses in the rear edge of the discharge plate means have a substantially concave curved configuration.

31. The apparatus as recited in claim 30, wherein each of said discharge openings has a substantial "D" configuration.

* * * * *